US010744668B2

(12) United States Patent
Koch

(10) Patent No.: US 10,744,668 B2
(45) Date of Patent: Aug. 18, 2020

(54) SLICE CUTTING MACHINE WITH REMOVABLY CONNECTABLE TRAY

(71) Applicant: Bizerba SE & Co. KG, Balingen (DE)

(72) Inventor: Nikolaus Koch, Geislingen (DE)

(73) Assignee: BIZERBA SE & CO. KG, Balingen (DE)

( * ) Notice: Subject to any disclaimer, the term of this patent is extended or adjusted under 35 U.S.C. 154(b) by 62 days.

(21) Appl. No.: 15/953,516

(22) Filed: Apr. 16, 2018

(65) Prior Publication Data

US 2018/0311857 A1 Nov. 1, 2018

(30) Foreign Application Priority Data

Apr. 28, 2017 (DE) ..... 10 2017 109 196

(51) Int. Cl.

| | |
|---|---|
| ***B26D 7/30*** | (2006.01) |
| ***B26D 7/06*** | (2006.01) |
| ***B26D 1/153*** | (2006.01) |
| ***B26D 7/32*** | (2006.01) |
| *B26D 7/00* | (2006.01) |

(52) U.S. Cl.

CPC ..... *B26D 7/30* (2013.01); *B26D 1/153* (2013.01); *B26D 7/0616* (2013.01); *B26D 7/0683* (2013.01); *B26D 7/32* (2013.01); *B26D 2007/0018* (2013.01); *B26D 2210/02* (2013.01); *Y10T 83/182* (2015.04);

(Continued)

(58) Field of Classification Search

CPC . Y10T 83/182; Y10T 83/6515; Y10T 83/222; Y10T 83/2033; Y10T 83/6534; Y10T 83/8722; Y10T 83/7734; B26D 7/30; B26D 7/32; B26D 7/0616; B26D 7/225; B26D 1/15; B26D 2210/02; G01G 19/52; G01G 19/56; G01G 19/4144

USPC ..... 83/167; 108/97–98, 698, 65, 69

See application file for complete search history.

(56) References Cited

U.S. PATENT DOCUMENTS 883,323 A * 3/1908 Macduff ..... A47B 96/027 248/250
2,001,769 A * 5/1935 Campbell ..... B26D 1/143 83/167

(Continued)

FOREIGN PATENT DOCUMENTS

CH 497248 A * 10/1970 ..... B26D 1/15
DE 1751114 U 8/1957

(Continued)

*Primary Examiner* — Laura M Lee

(74) *Attorney, Agent, or Firm* — Leydig, Voit & Mayer Ltd.

(57) ABSTRACT

An electrically operated slice cutting machine separates slices from strand-shaped products, such as food products. The machine includes a machine housing, which holds a drive motor and a rotating cutting blade driven by the drive motor. The machine housing has a storage region near the cutting blade. A tray for receiving slices is removably coupled to the machine housing or to an attachment part of the machine housing. The tray is coupled in a horizontal operating position during a cutting operation, and is movable in at least one removal position, in which the tray is configured to be released and removed from the coupling device, when outside of the cutting operation. The coupling device has an upper and a lower coupling arm. Both coupling arms form a coupling recess, which is open on one side.

14 Claims, 3 Drawing Sheets

(52) U.S. Cl.
CPC ..... *Y10T 83/2033* (2015.04); *Y10T 83/222* (2015.04); *Y10T 83/6515* (2015.04)

(56) References Cited

U.S. PATENT DOCUMENTS 2,121,350 A * 6/1938 Folk ..... B26D 7/01 83/719
2,182,708 A * 12/1939 Shlevin ..... B26D 1/143 83/545
2,438,937 A * 4/1948 Metzler ..... B26D 7/32 83/167
2,479,182 A 8/1949 Peters
4,070,941 A * 1/1978 Lorenz ..... B26D 7/24 83/397
4,246,821 A * 1/1981 Fuse ..... B26D 7/00 83/571
4,612,836 A * 9/1986 Henn ..... B26D 7/01 83/699.61
4,821,892 A * 4/1989 Randall ..... A47B 96/063 108/108
4,934,642 A * 6/1990 Baron ..... A47B 96/065 108/108
5,478,018 A * 12/1995 Wang ..... A47J 43/25 241/100
6,364,263 B1 * 4/2002 Ryan ..... A47B 96/06 248/239
7,270,481 B1 * 9/2007 Chang ..... B26D 7/01 384/50
2003/0200854 A1 * 10/2003 Graef ..... B26D 1/143 83/707
2016/0082613 A1 3/2016 Koch
2017/0144322 A1 * 5/2017 Heck ..... B26D 7/30

FOREIGN PATENT DOCUMENTS

DE 2707534 A1 8/1978
DE 8807446 U1 11/1988
DE 102014113505 A1 3/2016
EP 3088146 A1 11/2016
GB 1080990 A * 8/1967 ..... B26D 1/153
JP 2005137827 A * 6/2005 ..... A47B 96/06
WO WO-2015173084 A1 * 11/2015 ..... G01G 19/56

* cited by examiner

SLICE CUTTING MACHINE WITH REMOVABLY CONNECTABLE TRAY

CROSS-REFERENCE TO PRIOR APPLICATION

Priority is claimed to German Patent Application No. DE 10 2017 109 196.3, filed on Apr. 28, 2017, the entire disclosure of which is hereby incorporated by reference herein.

FIELD

The invention relates to a slice cutting machine for separating slices from, in particular, strand-shaped products to be cut, preferably food products, having a machine housing, which holds a drive motor and a rotating cutting blade, driven by the drive motor, and having a storage region arranged in the region of the cutting blade with an essentially planar tray for receiving separated slices, wherein the tray may be removably connected by means of a coupling device to the machine housing or to an attachment part of the machine housing, wherein the tray during cutting operation is connected in a horizontal operating position and wherein, when outside of the cutting operation, the tray may be moved into at least one removal position, in which the tray may be released and removed from the coupling device.

BACKGROUND

In such a slice cutting machine, in particular in automatically operated slice cutting machines for strand-shaped food products, such as sausages, ham, salmon, cheese, etc., the product to be cut is moved against the cutting blade in order to separate the slices by cutting.

The drive of the cutting device is performed by a drive motor, which is normally enclosed by the machine housing, in order to protect it against splash water and dirt as well as to provide mechanical security against intervention from the outside.

The separated slices then reach the storage region, either automatically or by means of a storage device, such as a motorized chain rack. In the storage region, the slices are deposited on the tray.

The tray is used for receiving the separated slices. The tray may also be connected to a weighing device, so that the weight of the slices, and thus the total amount cut may be directly detected.

In particular in the food sector, particularly high requirements exist for ensuring hygiene.

Thus a regular thorough cleaning of the slice cutting machine and in particular of the tray is necessary. To this end, the tray may be moved into a removal position. In this removal position, the tray may be removed for cleaning purposes.

After cleaning is completed, the tray is again mounted on the slice cutting machine, so that further slices may subsequently be separated and collected on the tray.

Such a generic slice cutting machine is disclosed in DE 10 2014 113 505 A1.

In this machine, a tray is provided with a rotational axis, so that the tray may be rotated into a vertical removal position.

In order to be removed, the tray has initially to be rotated into the vertical removal position, and subsequently laterally displaced along the rotational axis out of a coupling device for coupling the tray to the rest of the slice cutting machine.

An easier removal and return of the tray would be desirable. Often, because of a lack of available space, it is difficult for example to tilt the tray into a vertical position and to displace it laterally. During tilting into the vertical position, it may also occur that cutting residues fall or slide off from the tray, for example behind or beside the rest of the slice cutting machine, so that additional cleaning is then required.

It has also been shown that in such a slice cutting machine of the prior art, the coupling device itself is relatively sharply angled and thus is difficult to clean.

In such a prior art slice cutting machine, considerable complexity and loss of convenience has to be taken into account, in order to regularly ensure the required hygiene, in particular of the tray.

SUMMARY

In an embodiment, the present invention provides an electrically operated slice cutting machine for separating slices from, in particular, strand-shaped products to be cut, preferably food products, comprising: a machine housing, which holds a drive motor and a rotating cutting blade configured to be driven by the drive motor, and having a storage region arranged in a region of the cutting blade, having an essentially planar tray configured to receive separated slices, the tray being removably coupled to the machine housing or to an attachment part of the machine housing by a coupling device, the tray being coupled in a horizontal operating position during a cutting operation, and being movable in at least one removal position, in which the tray is configured to be released and removed from the coupling device, when outside of the cutting operation, wherein the coupling device has an upper and a lower coupling arm, and wherein both coupling arms form a coupling recess, which is open on one side, along a longitudinal direction, for coupling the tray.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
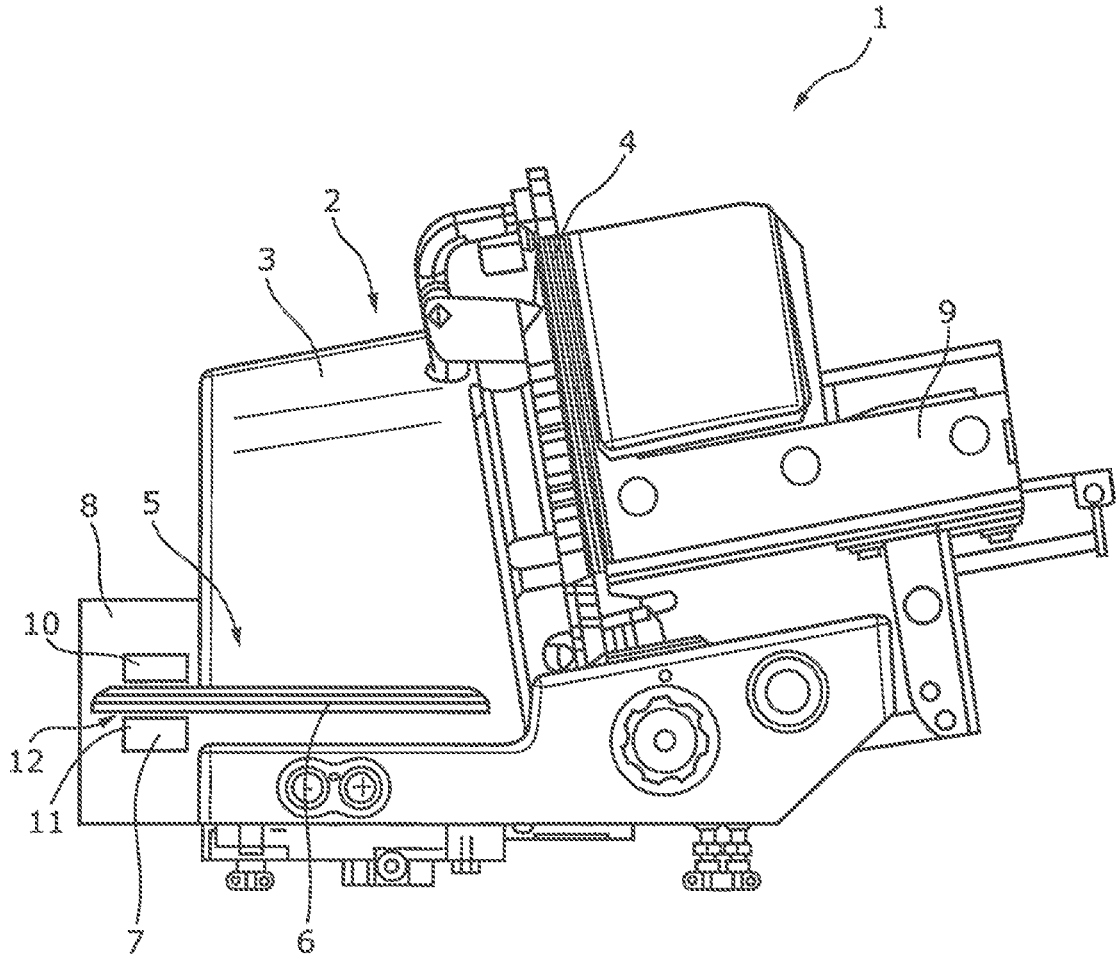
FIG. 1 is a perspective side view of a first embodiment of a slice cutting machine having a coupling device.

According to the invention, this object is achieved in a surprisingly simple and effective way in that the coupling device has an upper and a lower coupling arm, wherein both coupling arms form along a longitudinal direction a coupling recess, which is open on one side, for coupling the tray.

In this way, the tray may be introduced into or extracted from the coupling recess. Just a slight tilting or lifting may be sufficient to achieve this. It is thus not necessary to initially transfer the tray completely into a vertical position. The mounting and/or dismounting of the tray may also be performed without the use of tools.

Both coupling arms may a recess for receiving the tray, in which the tray is clamped to the coupling device. The recess may be constructed, for example, in the form of a gripper. The clamping action may in particular be caused by gravity.

The coupling recess may protrude vertically when the slice cutting machine is transferred into its usual horizontal mounting or installation position. The tray may then be provided, for example, with an undercut, which protrudes perpendicularly with respect to its essentially planar plane. For mounting, the undercut may engage in the vertical coupling recess or be introduced into said recess. The undercut may thus be fixed, in particular removably, between the two coupling arms. The rest of the tray may then be held on the coupling device.

In a particularly advantageous class of embodiments of the invention, the coupling recess may be open in the horizontal direction and preferably not in the vertical direction. Both coupling arms may also be directed, to this end, in the horizontal direction and/or substantially in the horizontal direction.

Thus, for mounting and/or dismounting the tray, the latter may be simply inserted laterally, optionally with an oblique orientation with respect to the horizontal direction, between the coupling arms, i.e. into the coupling recess, or be removed therefrom.

The coupling device and/or the tray may also be provided or formed with a fixing device for horizontally fixing the tray in its operating position. In this context, the operating position is to be understood as the position of the tray, in which it is used for the deposition of separated slices.

The fixing device may effectively prevent a lateral, in particular involuntary, slippage of the tray from the coupling device while the tray is in its operating position.

In particular, the fixing device may be formed by a fixing pin and a fixing recess. The fixing pin and the fixing recess may preferably be formed in a complementary manner, in particular according to the key/keyhole principle. For fixing, the fixing pin may be thus engage in the fixing recess.

The fixing pin may be formed or positioned on the tray and the fixing recess may be formed or positioned on the coupling device, for example.

Alternatively, it is conceivable that the fixing pin is formed or positioned on the coupling device and the fixing recess is formed or positioned on the tray.

Further possible embodiments of a fixing device are also conceivable.

For example, the tray may also be fixed to the coupling device by means of a bolt, which is preferably removable without using tools. It is also conceivable that the fixing device, in particular the fixing pin, forms a click-fit system with the fixing recess. Thus the tray may be inserted into the coupling recess and then fixed to thereto by means of a click-fit action, in particular for use in its operating position.

It is particularly advantageous if the upper and the lower arm have different arm lengths. In particular, the upper coupling arm may be shorter than the lower coupling arm. In this way, it may be easier to introduce the tray into or to extract it from the coupling recess.

It is also conceivable that the coupling recess has at least one bevel, preferably at an angle between 5° and 80°, in particular between 10° and 30° with respect to the tray in its operating position. This further facilitates the removal or the return of the tray.

The lower coupling arm may be provided in such a way that it supports the underside of the tray in its operating position in a support region, preferably outside its center of gravity. In particular, it is conceivable that the tray is supported in an end region of the lower coupling arm.

The upper coupling arm may also be provided in such a way that it holds the tray in its operating position on the upper side, preferably as an abutment for the lower coupling arm. The lower and the upper coupling arm together may thus hold the tray by gravitational clamping. Other securing devices may thus be omitted.

It is also conceivable that the support region also extends over at least one tenth of the width of the tray defined in a transverse direction with respect to the longitudinal direction, i.e. in a transverse direction, of the coupling arms. The coupling device may thus also secure the tray against toppling in the transverse direction.

It is also conceivable that, in its removal position, the tray may be removed with a minimum removal angle obliquely to the horizontal direction.

The minimum removal angle may for example be 10 degrees or more. In this case, the tray may furthermore be removed without difficulty; however, an involuntary slippage of the tray in its operating position is effectively prevented.

A weighing device may also be provided, which is formed as an attachment part, and the tray may be coupled to the weighing device by means of the coupling device. Thus the tray may be coupled to the slice cutting machine by means of the weighing device. In addition, the weight of the separated slices may be measured and/or monitored. Thus the weighing device may be provided with a double functionality.

Further features and advantages of the invention emerge from the following detailed description of embodiments of the invention with reference to the drawings, which show details essential for the invention, as well as from the claims.

The individual features may be implemented separately or in any of a plurality of combinations in variants of the invention. Embodiments of the invention are shown in the schematic drawings and are explained in more detail in the following description.

To facilitate understanding of the embodiments, the same reference numerals are used in the drawings for corresponding elements.

FIG. 1 shows an electrically operated slice cutting machine 1 for separating slices from an in particular strand-shaped product to be cut, having a machine housing 2, which holds in a motor turret 3 a drive motor and a rotating cutting blade 4, which is driven by the drive motor. The slice cutting machine 1 also has a storage region 5 positioned in the region of the cutting blade 4, which storage region is provided with an essentially planar tray 6 for receiving separated slices. The tray 6 is removably coupled, by means of a coupling device 7, to a weighing device 8, which is formed as an attachment part of the machine housing 2.

The product to be cut may be positioned on a slide 9. In order to cut the slices, the slide 9 may then be moved in parallel to a cutting plane defined by the cutting blade 4 along the cutting blade 4.

FIG. 1 shows a state in which the slice cutting machine 1 is in a cutting operation. In this cutting operation, slices separated by the cutting blade 4 may be deposited or collected on the tray 6. To this end, the tray 6 is in its operating position which, in this embodiment is expediently arranged in a horizontal position for collecting the slices. In the operating position, the tray 6 is coupled to the coupling device 7.

The coupling device 7 has an upper coupling arm 10 and a lower coupling arm 11. To this end, the coupling device 7 is substantially U-shaped. In particular, a coupling recess 12, open on one side, is formed between the coupling arms 10, 11 for coupling the tray 6. The coupling recess 12 has a horizontally oriented opening. In this coupling recess 12—and thus between the two coupling arms 10, 11—the tray 6 is accordingly arranged in its operating position.

As described in more detail below, the tray 6 may also be moved into a removal position, in particular with respect to the coupling device 7. In this position, it may be removed from the coupling device 7, for cleaning purposes, for example, or inserted again into the coupling device.

Figure 2:
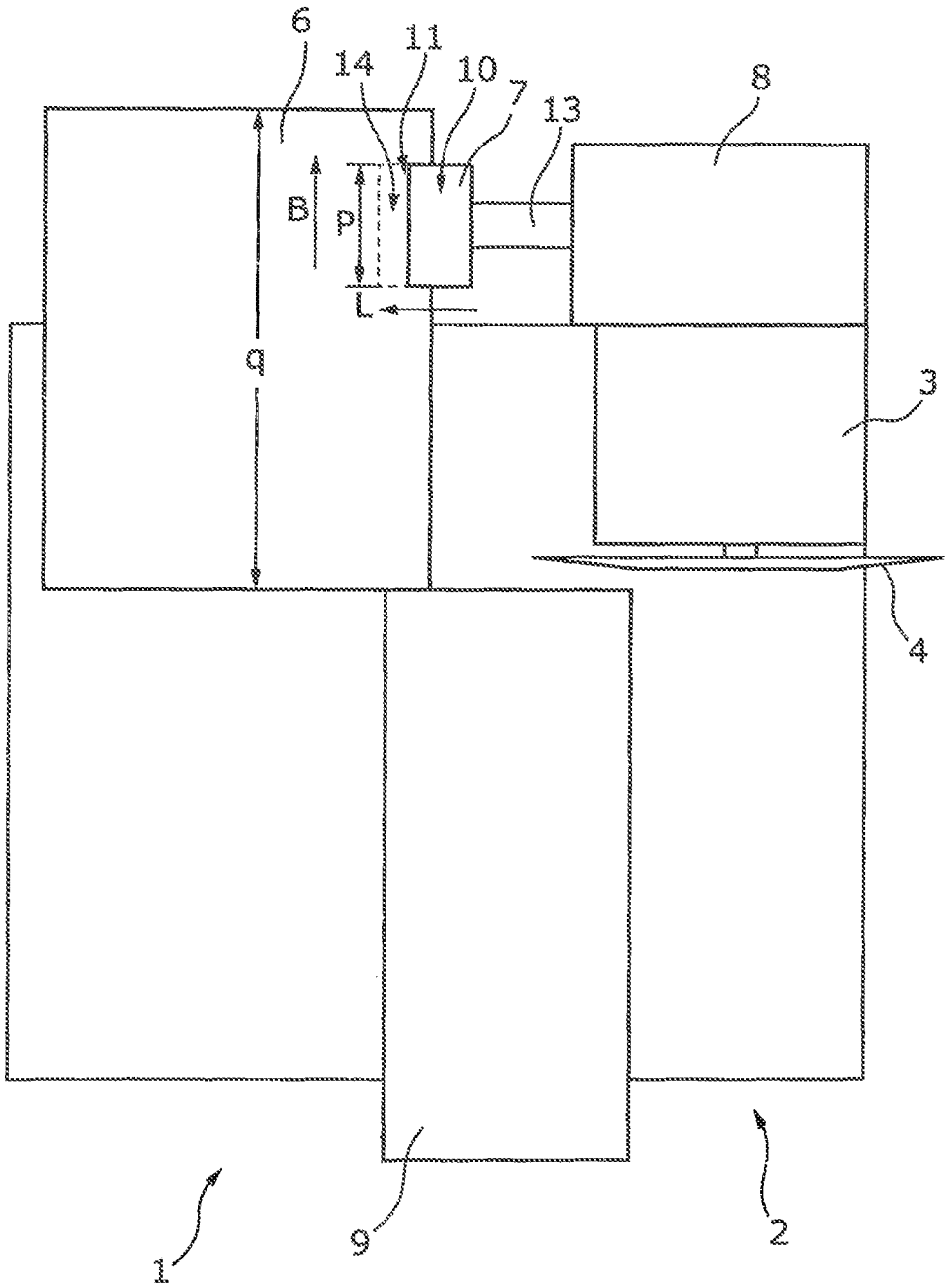
FIG. 2 is a schematic plan view of the slice cutting machine of FIG. 1.

FIG. 2 shows the slice cutting machine 1 of FIG. 1 with its machine housing 2, the motor turret 3, the cutting blade 4, the tray 6, the coupling device 7 and the weighing device 8 in a plan view from above in a highly schematic representation.

In the plan view of FIG. 2, the two coupling arms 10, 11 are also visible, which extend lengthwise in a longitudinal direction L and widthwise in a width direction B which is oriented transversely with respect to the longitudinal direction L.

The coupling recess 12 formed by the two coupling arms 10, 11 (FIG. 1) is thus configured along the longitudinal direction L. Its one-sided opening is thus positioned on the side facing away from the weighing device 8.

The coupling device 7 and, in this preferred embodiment, also the coupling arms 10, 11 have a width p along the width direction B, which is at least equal to one tenth of the width q of the tray 6. The width q of the tray 6 is in turn to be measured along the width direction B and thus transversely to the longitudinal direction L of the coupling arms 10, 11. In this embodiment, the width p of coupling device 7 is at least equal to 20 percent of the width q of the tray 6.

In other words, the tray 6 is supported along the width of the coupling device 7 and here within a support region 14 on the coupling device 7. The width of the coupling device 7 and thus of the support region 14 extends over at least one tenth of the width of the tray 6.

It may also be seen that the coupling device 7 has a holding arm 13, via which it is connected to the weighing device 8. The holding arm 13 thus allows the transmission of loads to the weighing device 8. The length of the holding arm 13 is selected in such a way that separated slices are correctly deposited onto the tray 6.

The selected width p of the support region 14 in this embodiment is larger than the width of the holding arm 13. Among other things, in this way and in particular due to the mentioned selection of width p, the tray 6 is secured against rotation about the longitudinal direction L.

Figure 3A:
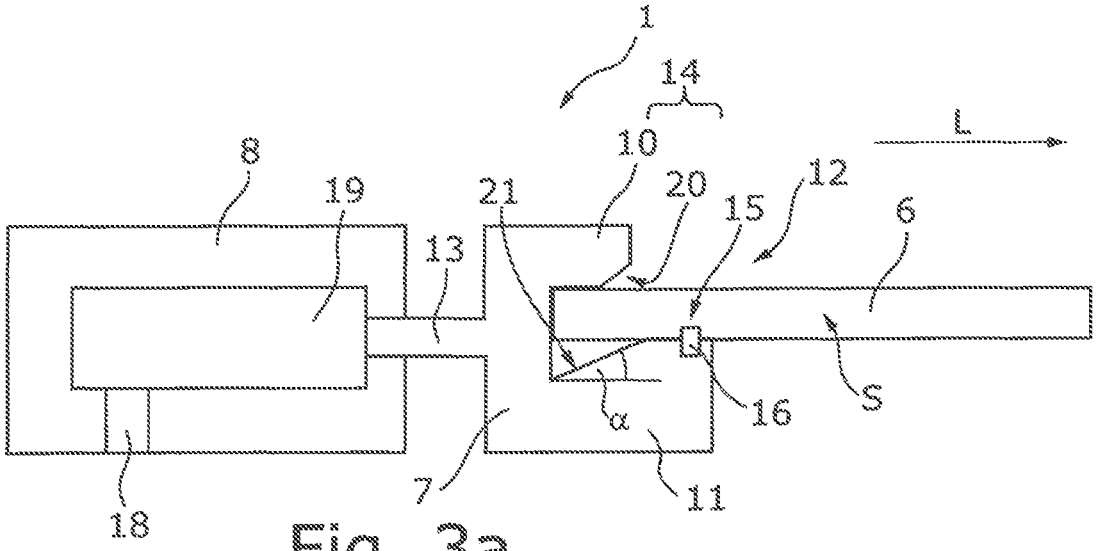
FIGS. 3*a*, 3*b* are schematic side views of the slice cutting machine of FIG. 1 with a tray in its operating position (FIG. 3*a*) and in its removal position (FIG. 3*b*)
Figure 3B:
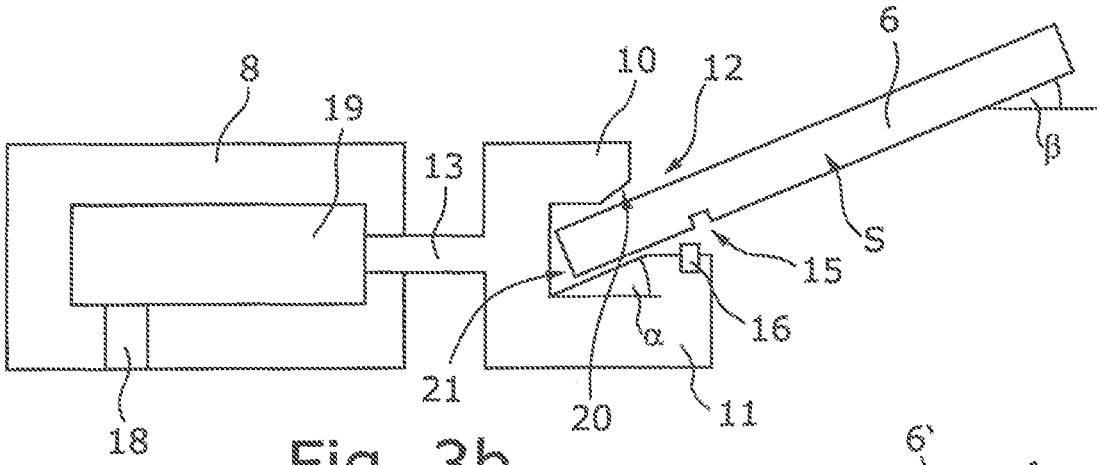

FIG. 3*a*, 3*b* show—also in each case in a highly schematic representation—side views of the slice cutting machine 1 of FIG. 1. The coupling device 7 can be seen which is positioned at the weighing device 8, with its coupling arms 10, 11 forming the coupling recess 12, and the holding arm 13. The holding arm 13 engages a weighing cell 19 of the weighing device 8. The weighing cell 19 is secured to the rest of the housing of the weighing device 8 by means of a securing device 18.

In both drawings the tray 6 is also shown. In the state according to FIG. 3*a*, the tray 6 is in its operating position, whereas the state according to FIG. 3*b* shows the tray 6 in its removal position.

The slice cutting machine 1 according to FIGS. 3*a* and 3*b* has a fixing device for horizontally fixing the tray in its operating position. The fixing device is formed by a fixing pin 16 and a fixing recess 15. In this embodiment, the fixing recess 15 is provided on underside of the tray 6. The fixing pin 16 is positioned on the coupling device 7, in particular on the lower coupling arm 11.

As may be seen in FIG. 3*a*, the fixing pin 16 engages, in the operating position of the tray 6, the fixing recess 15. The tray 6 is thus secured by the fixing device against an in particular involuntary displacement in the horizontal direction.

The lower coupling arm 10 is configured in particular in such a way that it supports the underside of the tray 6 in its operating position in the support region 14 outside of its center of gravity S. To this end, the fixing recess 15 and the fixing pin 16 are correspondingly positioned with respect to the lower coupling arm 10.

Moreover, the upper coupling arm 11 is configured in such a way that it forms an abutment for the lower coupling arm 10. Thus it holds the tray 6 in its operating position on the upper side. Consequently, a coupling by gravitational clamping of the tray 6 within the coupling device 7 is achieved.

It may be seen that the upper coupling arm 10 is considerably shorter along the longitudinal direction L than the lower coupling arm 11.

The coupling recess 12 also has two bevels 20, 21. The bevels 20, 21 are inclined against the tray 6 in its operating position, i.e. in this embodiment, against the horizontal direction. In this embodiment, in particular, the inclination angle $\alpha$ of the bevel 21 with respect to the tray 6 in its operating position is equal to about 25°.

As shown in FIG. 3*b*, the tray 6 in its removal position is inclined with respect to the horizontal direction with a minimum removal angle $\beta$. In this embodiment, the minimum removal angle $\beta$ essentially corresponds to the angle $\alpha$. Thus the tray 6 may be removed, in that it is inclined by the minimum removal angle $\beta$ with respect to the horizontal direction. Expediently, the tray 6 has to be slightly lifted, in order to extract the fixing pin 16 from the fixing recess 15.

Figure 3C:
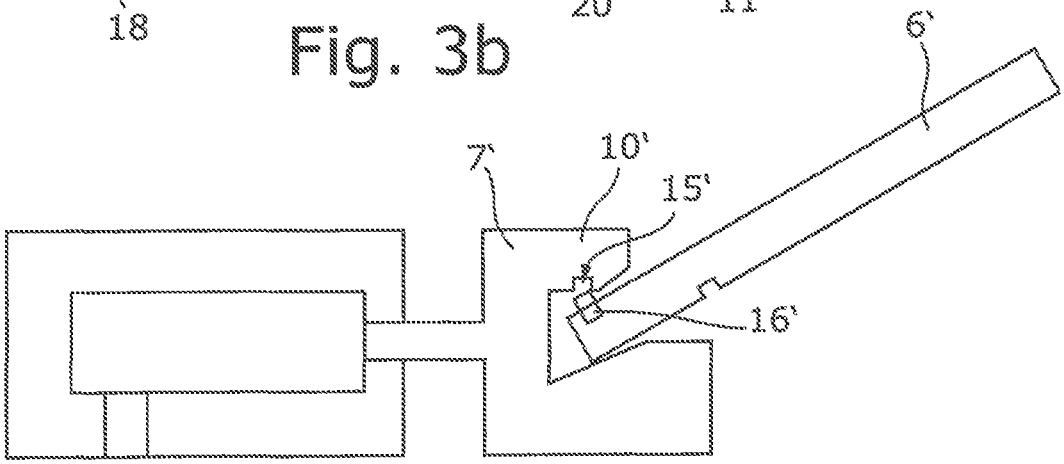
FIG. 3*c* is a schematic side view of an alternative embodiment of the slice cutting machine with a tray in its removal position.

FIG. 3*c* finally shows an alternative embodiment of a slice cutting machine according to the invention, also in a highly schematic representation in a side view. This embodiment essentially corresponds to the previously described embodiment of FIGS. 1, 2, 3*a* and 3*b*. The only substantial difference lies in the type of configuration of the fixing device.

The slice cutting machine of this embodiment also has a coupling device 7' having an upper coupling arm 10' and a lower coupling arm 11'. However, the upper coupling arm 10' now has a fixing recess 15' on the underside for engaging a fixing pin 16' positioned on the upper side of a tray 6', in the operating position of the tray 6'.

In these embodiments, the fixing devices extend in each case over the entire width of the coupling devices. In further alternative embodiments, however, the fixing devices extend only over a portion of the width of the coupling device.

In conclusion, by looking at all the drawings together, the invention relates to an electrically driven slice cutting machine for separating slices, in particular of strand-shaped products, preferably food products. The slice cutting machine in particular has an improved tray for depositing separated slices. The tray may be coupled to and decoupled from the slice cutting machine, in particular without using tools, by means of a coupling device. It is particularly simple to mount or to remove the tray. To this end, the coupling device is provided with two coupling arms, which form a coupling device. The tray may be clamped, in particular by gravity, in the coupling device. In order to prevent a lateral slippage of the tray in its operating position, a fixing device is also provided, which is formed on the coupling device and on the tray.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 slice cutting machine
2 machine housing
3 motor turret
4 cutting blade
5 storage region
6, 6' tray
7, 7' coupling device
8 weighing device
9 slide
10, 10' upper coupling arm
11, 11 lower coupling arm
12 coupling recess
13 holding arm
14 support region
15, 15' fixing recess
16, 16' fixing pin
18 fixing device
19 weighing cell
20, 21 bevel
B width direction
L longitudinal direction
q width
S center of gravity
$\alpha$ angle
$\beta$ minimum removal angle

What is claimed is:

1. An electrically operated slice cutting machine for separating slices from strand-shaped products, the slice cutting machine comprising:

a machine housing, which holds a drive motor and a rotating cutting blade configured to be driven by the drive motor, and having a storage region arranged in a region of the cutting blade, having an essentially planar tray configured to receive separated slices, the tray being removably coupled to the machine housing or to an attachment part of the machine housing by a coupling device, the tray being coupled in a horizontal operating position during a cutting operation, and being movable in at least one removal position, in which the tray is configured to be released and removed from the coupling device, when outside of the cutting operation, wherein the coupling device has an upper and a lower coupling arm, and wherein both coupling arms form a coupling recess, which is open on one side, along a longitudinal direction, for coupling the tray, wherein the coupling device is designed such that the tray is insertable directly, without an intermediate piece, into the coupling recess and, in an operating state of the slice cutting machine, the tray extends parallel to the longitudinal direction of the coupling recess and a top surface of the tray contacts the upper coupling arm and a bottom surface of the tray contacts the lower coupling arm, wherein the coupling device and/or the tray have or form a fixing device configured to horizontally fix the tray in its operating position, wherein the fixing device comprises a fixing pin and a fixing recess, wherein either:

the fixing pin is formed or positioned on the tray and the fixing recess is formed or positioned on the coupling device, or the fixing pin is formed or positioned on the coupling device and the fixing recess is formed or positioned on the tray, and wherein the fixing pin or the fixing recess is formed in the coupling device between the upper coupling arm and the lower coupling arm, wherein the slice cutting machine further comprises a weighing device, the weighing device comprising an attachment part, and wherein the tray is configured to be coupled to the weighing device by the coupling device.

2. The slice cutting machine of claim 1, wherein the coupling recess is open in the horizontal direction.

3. The slice cutting machine of claim 1, wherein the upper and the lower coupling arm have different arm lengths.

4. The slice cutting machine of claim 1, wherein the coupling recess has at least one bevel forming an angle of between 5° and 80° with the tray in its operating position.

5. The slice cutting machine of claim 4, wherein the angle is between 10° and 30°.

6. The slice cutting machine of claim 1, wherein the lower coupling arm is configured to support an underside of the tray in its operating position in a support region.

7. The slice cutting machine of claim 6, wherein the support region extends over at least one tenth of a width of the tray defined in a transverse direction with respect to the longitudinal direction of the coupling arms.

8. The slice cutting machine of claim 6, wherein the lower coupling arm is configured to support the underside of the tray in its operating position in the support region outside of the tray's center of gravity.

9. The slice cutting machine of claim 1, wherein the upper coupling arm is configured to hold the tray in its operating position on its upper side.

10. The slice cutting machine of claim 9, wherein the upper coupling arm is configured to hold the tray in its operating position on its upper side to act as an abutment for the lower coupling arm.

11. The slice cutting machine of claim 1, wherein the tray is configured to be removed in its removal position obliquely with respect to a horizontal direction according to a minimum removal angle.

12. The slice cutting machine of claim 1, wherein the fixing pin extends from the top surface of the tray, the bottom surface of the tray, a surface of the upper coupling arm, or a surface of the lower coupling arm, wherein in the operating state of the slice cutting machine with the tray being inserted into the coupling recess, the fixing pin is inserted in the fixing recess.

13. The slice cutting machine of claim 12, wherein the fixing recess at least partially covers three sides of the fixing pin.

14. The slice cutting machine of claim 1, wherein in the operating state of the slice cutting machine a first end of the tray configured to be within the coupling recess such that the top surface of the tray adjacent to the first end contacts a bottom surface of the upper coupling arm that defines the coupling recess, and at least a portion of the bottom surface of the tray contacts a portion of an upper surface of the lower coupling arm that does not oppose the upper coupling arm.

* * * * *